US009982518B2

(12) United States Patent
Seguin et al.

(10) Patent No.: US 9,982,518 B2
(45) Date of Patent: May 29, 2018

(54) PRODUCTION RISER WITH A GAS LIFT FACILITY

(71) Applicant: Acergy France SAS, Suresnes (FR)

(72) Inventors: Blaise Seguin, Suresnes (FR); Benoit Vigot, Paris (FR); Emmanuel Guilloir, Paris (FR)

(73) Assignee: Acergy France SAS, Suresnes (FR)

( * ) Notice: Subject to any disclaimer, the term of this patent is extended or adjusted under 35 U.S.C. 154(b) by 0 days. days.

(21) Appl. No.: 15/307,352

(22) PCT Filed: Apr. 20, 2015

(86) PCT No.: PCT/IB2015/001050
§ 371 (c)(1),
(2) Date: Oct. 27, 2016

(87) PCT Pub. No.: WO2015/166346
PCT Pub. Date: Nov. 5, 2015

(65) Prior Publication Data

US 2017/0051589 A1 Feb. 23, 2017

(30) Foreign Application Priority Data

Apr. 28, 2014 (GB) ..... 1407461.1

(51) Int. Cl.

| | |
|---|---|
| ***E21B 17/01*** | (2006.01) |
| ***E21B 36/00*** | (2006.01) |
| ***E21B 43/01*** | (2006.01) |
| ***E21B 29/12*** | (2006.01) |
| ***E21B 17/08*** | (2006.01) |
| ***E21B 43/12*** | (2006.01) |

(52) U.S. Cl.
CPC ..... *E21B 43/122* (2013.01); *E21B 17/01* (2013.01); *E21B 17/015* (2013.01); *E21B 36/00* (2013.01); *E21B 36/005* (2013.01); *E21B 36/006* (2013.01)

(58) Field of Classification Search
USPC ..... 166/367
See application file for complete search history.

(56) References Cited

U.S. PATENT DOCUMENTS

| | | | |
|---|---|---|---|
| 5,040,826 | A | 8/1991 | Lovell |
| 6,012,495 | A | 1/2000 | Antonsen |

(Continued)

FOREIGN PATENT DOCUMENTS

| | | |
|---|---|---|
| EP | 2 304 171 | 4/2011 |
| GB | 2 346 188 | 8/2000 |

(Continued)

*Primary Examiner* — Matthew R Buck
*Assistant Examiner* — Douglas S Wood
(74) *Attorney, Agent, or Firm* — Levy & Grandinetti

(57) ABSTRACT

A subsea riser system with a gas-lift facility has a production riser having a riser conduit and at least one lift gas injection port communicating with the riser conduit. An umbilical is arranged to supply lift gas to the lift gas injection port. A heating unit is positioned to act on a downstream end region of the umbilical adjacent to the lift gas injection port. A method of providing lift gas to a subsea riser system includes the steps of conveying lift gas toward a production riser and, before injecting the lift gas into the production riser, heating the lift gas locally adjacent to the production riser.

7 Claims, 5 Drawing Sheets

(56) References Cited

U.S. PATENT DOCUMENTS

| | | | | |
|---|---|---|---|---|
| 6,253,855 | B1 | 7/2001 | Johal et al. | |
| 7,123,826 | B2 | 10/2006 | Belcher | |
| 7,367,398 | B2 * | 5/2008 | Chiesa | E21B 17/01 166/272.1 |
| 8,191,646 | B2 * | 6/2012 | Kinnari | E21B 37/06 166/401 |
| 8,342,248 | B2 * | 1/2013 | Hall | E21B 17/01 166/344 |
| 2006/0131027 | A1 | 6/2006 | Chiesa et al. | |
| 2010/0032164 | A1 | 2/2010 | Bakke | |
| 2012/0275774 | A1 | 11/2012 | Goering et al. | |

FOREIGN PATENT DOCUMENTS

| | | |
|---|---|---|
| GB | 2 351 301 | 12/2000 |
| GB | 2 448 200 | 10/2008 |
| WO | WO 97/20162 | 6/1997 |
| WO | WO 00/079017 | 12/2000 |
| WO | WO 01/16515 | 3/2001 |
| WO | WO 01/73261 | 10/2001 |
| WO | WO 2012/051148 | 4/2012 |

* cited by examiner

PRODUCTION RISER WITH A GAS LIFT FACILITY

This invention relates to riser systems for subsea oil and gas production. In particular, the invention relates to riser systems that employ gas-lift techniques to assure flow of production fluid, which fluid may comprise crude oil and/or natural gas.

After extraction at a subsea wellhead, production fluid is typically carried as a wellstream along a pipeline on the seabed, commonly referred to in the art as a spool or tie-back, and then up a riser to a surface unit for temporary storage, optional processing and onward transportation. One of many examples of a subsea riser is disclosed in WO 2012/051148. A riser with a servicing device that can be displaced within the riser in order to avoid having to repair or replace the device in situ, adjacent to the sea bed, is described in WO 01/73261. Examples of surface units include: platforms; floating process, storage and offloading vessels (FPSOs); onshore plants; and floating liquefaction of natural gas vessels (FLNGs).

Production fluid can only pass up a riser to reach a surface unit if the wellstream has a high-enough pressure, temperature and flow rate at the bottom of the riser. For example, if the temperature is too low and if there is enough water in the wellstream, wax or hydrate compounds may form and deposit inside the pipeline and so restrict or eventually block the flow. This is a particular risk during shutdown periods. Also, where the production fluid contains crude oil, low temperature increases the viscosity of the production fluid and hence the difficulty of raising the production fluid to the surface.

Broadly, the invention is concerned with the challenge of enabling production fluid to be recovered from the base or foot of a riser, where flow conditions such as density, flow rate and pressure are not sufficient by themselves for the production fluid to reach the surface level effectively without assistance.

There are two conventional approaches to this challenge. One approach is to pump the production fluid, but this is not relevant to the present invention because pumping is too complex and expensive for many applications. The other approach is to employ a gas-lift technique, in which a pressurised lift gas is injected into the flow of production fluid in order to decrease the density of the fluid. Decreasing density in this way allows the resulting liquid/gas mixture to flow more easily up the riser, in a direction downstream from the point of injection.

Gas lift is a well-known and widely-used technique but it requires the addition of gas-lift piping such as a dedicated umbilical, and a way to inject the gas from the piping into the flow of production fluid. Also, backflow of production fluid into the gas lift line is a concern as it may result in blockage of the gas lift line due to deposition of wax or hydrate formation.

These issues tend to complicate the design of the riser base, which may need to provide a connection for the gas lift line and support one or more valves to control lift gas flow and/or to avoid backflow of production fluid into the gas lift line. Special forged pieces may be required to support the valves and to inject the lift gas. Servicing or replacing gas-lift components integrated into a riser, such as the gas lift line or the various valves, may be difficult or impossible given the depths at which such components typically operate.

An alternative solution is to embed the gas lift line within the same thermal insulation that insulates the production line, so that the gas lift line is heated by thermal conduction from hot production fluid. This solution requires complicated pipe structures that are expensive, such as pipe-in-pipe and bundle structures.

Gas-lift umbilicals comprise tubing that can withstand gas pressure and corrosion. U.S. Pat. No. 6,012,495 and WO 00/79017 show the typical cross-section of an umbilical, comprising a tubular conduit surrounded by power cables, all protected by an outer sheath.

Those skilled in the art of subsea oil and gas production understand the clear distinction between rigid or flexible pipes for transporting production fluid from a wellhead or seabed toward the surface and gas-lift umbilicals, which transport lift gas in the opposite direction to support the production process. A key difference is that production lines often provide for active heating along their entire length whereas known gas-lift umbilicals are not actively heated at all.

For example, it is known from US 2012/0275774 and U.S. Pat. No. 7,123,826 to apply electrical heating to multi-layer composite flexible pipes to maintain temperature in a production fluid. Similarly, heating of production pipes by a flow of hot water is known in WO 01/16515, in which example heating is applied to the production pipe of a bundle of pipes.

In WO 97/20162, multiple flexible tubes are bundled together in one structure. A central tube of the bundle carries production fluid whereas outer tubes of the bundle may comprise gas lift lines, service lines, power cables or heating lines.

All of the above-described arrangements for heating production lines are expensive and are not apt to be applied to gas-lift umbilicals. Instead, the approach to gas-lift umbilicals in the prior art has been to heat them passively, if at all, by virtue of incidental heat transfer from the production fluid.

In this respect, reference is made to FIGS. 1 and 2, that illustrate the prior art.

FIGS. 1 and 2 show gas-lift solutions akin to those disclosed in GB 2351301, U.S. Pat. No. 6,253,855 and GB 2346188, in which compressed lift gas is channelled down an annulus 10 between outer and inner pipes 12, 14 of a pipe-in-pipe riser 16. In both cases, the inner pipe 14 carries production fluid upwardly from the seabed toward the surface and so serves as a production conduit.

The lift gas may start its journey down the riser 16 at an elevated temperature by virtue of undergoing compression immediately beforehand. Also, during its journey down the riser 16, proximity of the lift gas to the hot production fluid may promote heat transfer from the production fluid to the lift gas. Both factors may raise the temperature of the lift gas to reduce cooling of the production fluid where the lift gas mixes with the production fluid at a gas injection level situated lower down the riser 16. However, any heat transferred to the lift gas in the riser 16 will unhelpfully reduce the temperature of the production fluid as the production fluid traverses the riser 16.

FIG. 2 differs from FIG. 1 in that in FIG. 1, the downwardly-flowing lift gas fills the annulus 10, whereas in FIG. 2 the lift gas flows down within a pipe 18 positioned inside the annulus 10. Thus, in FIG. 2, the pipe 18 in the annulus 10 serves as a lift gas conduit whereas in FIG. 1, the annulus 10 itself serves as a lift gas conduit.

In both cases, the lift gas conduit communicates with the production conduit defined by the inner pipe 14 at a suitable gas injection level of the riser 16. The gas injection level is usually at or near to the base of the riser 16, hence close to the seabed. However, in particularly deep water, it has been proposed in EP 2304171 to inject lift gas at an elevated position along a riser, hence in mid-water and thus at a substantial height above the seabed. In that case, injection takes place at a depth where the hydrostatic pressure is below the cricondenbar of the production fluid and preferably where the pressure in the riser is below the bubble point pressure of the production fluid. As will be explained, both of these possible gas injection levels are contemplated within the inventive concept.

In conventional gas lift arrangements, a check valve is necessary between the lift gas conduit and the production conduit to prevent production fluid entering the lift gas conduit. If production fluid enters the lift gas conduit, the formation and deposition of waxes and hydrates from the production fluid could block the lift gas conduit and hinder or prevent further injection of lift gas.

Against this background, the invention provides an inexpensive, simple and easy-to-maintain solution that provides hot gas injection for gas lift and avoids hydrate formation, without dependence upon common thermal insulation systems such as pipe-in-pipe or integrated flexible bundles.

In one sense, the invention resides in a subsea riser system with a gas-lift facility, the system comprising:

- a production riser comprising a riser conduit and at least one lift gas injection port communicating with the riser conduit;
- an umbilical arranged to supply lift gas to the lift gas injection port; and
- a heating unit positioned to act on a downstream end region of the umbilical adjacent to the lift gas injection port.

The invention enables the riser system to omit a check valve between the gas injection port and the umbilical.

Preferably, for ease of access, the umbilical is external to the production riser. In that case, at least a portion of the umbilical between the production riser and a lift gas supply suitably hangs as a catenary. However, a length of the umbilical may be attached to, and extend along, the production riser. The heating unit is also suitably external to the production riser.

The lift gas injection port is preferably embodied in a bulkhead component incorporated into the production riser, in which case the heating unit may be supported by the bulkhead component. Conveniently, the bulkhead component may also include an inlet for admitting production fluid into the production riser.

Thus, the inventive concept embraces a bulkhead component for a gas-lift facility of a subsea riser system, the bulkhead component comprising at least one lift gas injection port in fluid communication with a lift gas inlet, and a heating unit adjacent the lift gas inlet. The bulkhead component may further include an inlet for admitting production fluid into a production riser when in fluid communication with the bulkhead component.

The inventive concept extends to an umbilical for providing a gas-lift facility for a subsea riser system, the umbilical having a heating unit positioned to act on a downstream end region of the umbilical.

The inventive concept may also be expressed as a method of providing lift gas to a subsea riser system, the method comprising: conveying lift gas toward a production riser; and immediately before injecting the lift gas into the production riser, heating the lift gas locally adjacent to where the lift gas enters the production riser.

The lift gas is preferably conveyed the toward the production riser through water, externally of the riser. More generally, the lift gas is preferably conveyed toward the production riser without introducing external heat to the lift gas, before heating the lift gas locally when adjacent to a lift gas injection port of the production riser.

In summary, the invention provides a gas-lift system including a gas-lift umbilical that may or may not be attached along a riser, and a bulkhead or connector for connecting the umbilical to the riser for injection of lift gas into a flow of production fluid in a production conduit of the riser.

A downstream section of the gas lift umbilical is heated, which allows a check valve between the gas-lift umbilical and the production conduit to be eliminated. Preferably, heating of the gas lift umbilical is localised to the downstream section adjacent the production conduit of the riser.

The gas lift umbilical is preferably external to the riser for ease of installation, maintenance and replacement.

The bulkhead or connector component may also provide for the introduction of production fluid into the riser.

Reference has already been made to FIGS. 1 and 2 of the accompanying drawings to describe the drawbacks of prior art gas-lift solutions. In order that the invention may be more readily understood, reference will now be made, by way of example, to the remainder of the drawings. The list of figures is as follows.

Figure 6:
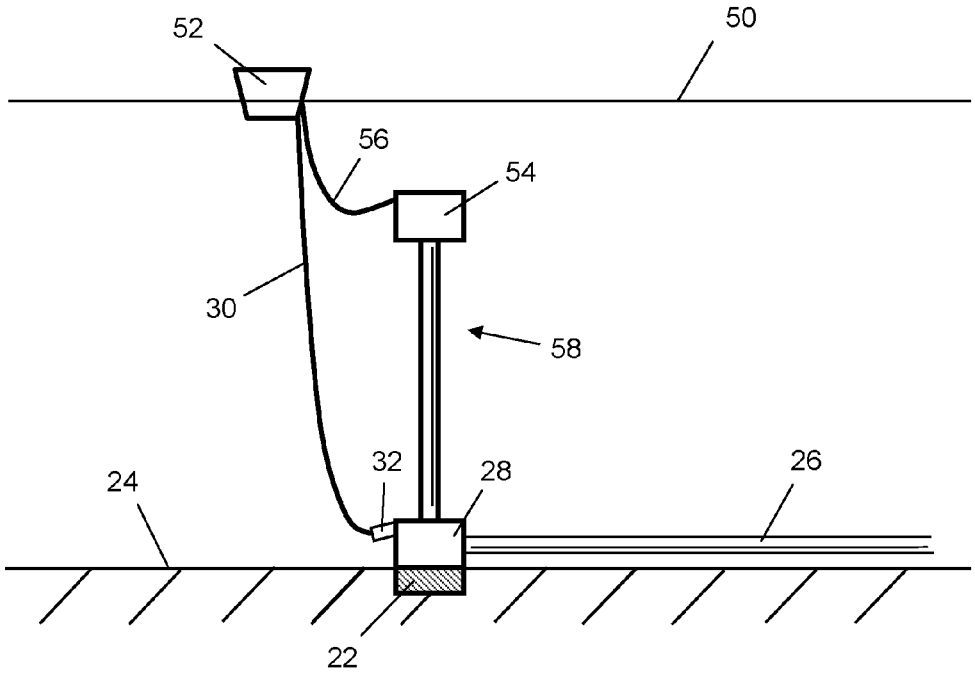
FIG. 6 is a schematic side view of a riser arrangement in accordance with the invention, showing lift gas injection at a base of a riser tower.
Figure 7:
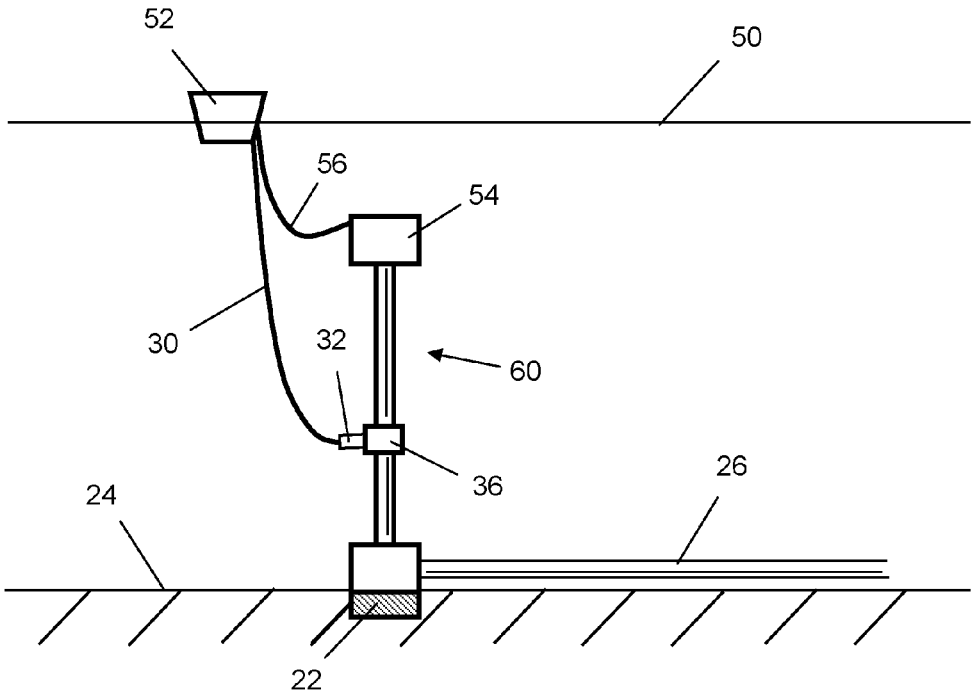
Figure 8:
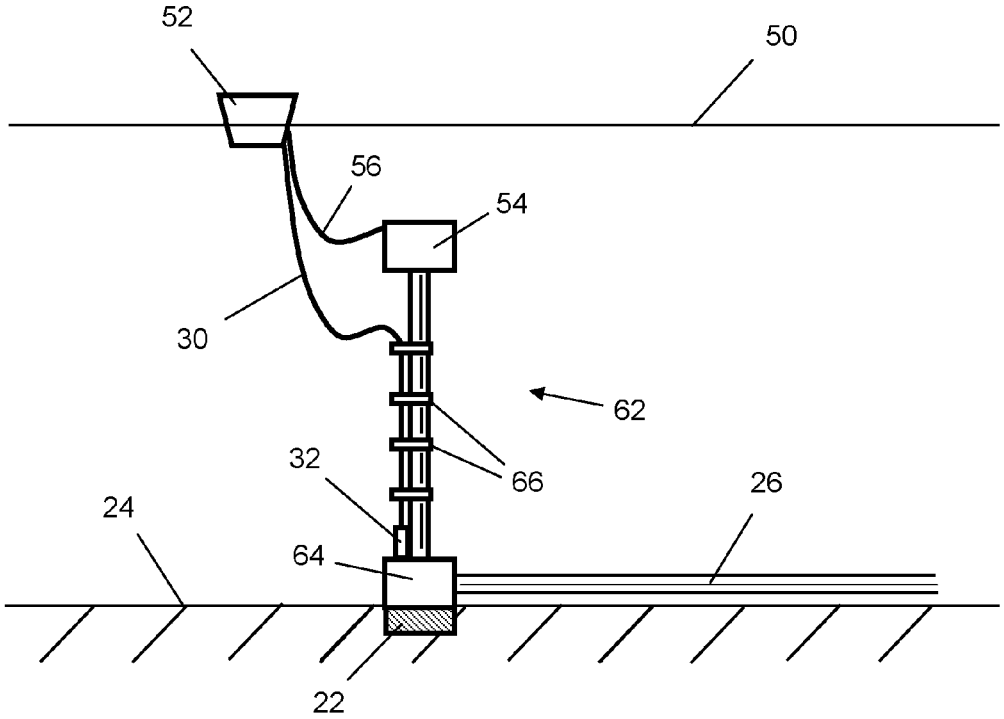
Figure 9:
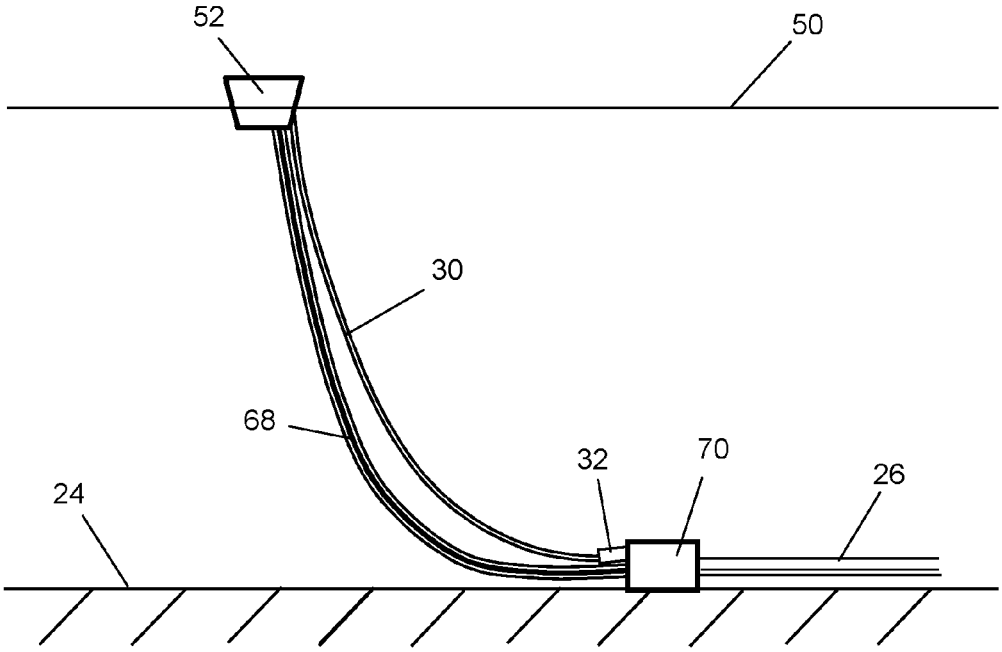

FIG. 7 corresponds to FIG. 6 but shows lift gas injection at an elevated position on the riser tower, substantially above the seabed;

FIG. 8 corresponds to FIG. 6 but shows a lift gas pipe following the riser tower along much of its length; and FIG. 9 is a schematic side view of another riser arrangement of the invention, in this case showing lift gas injection in the context of a steel catenary riser.

Figure 1:
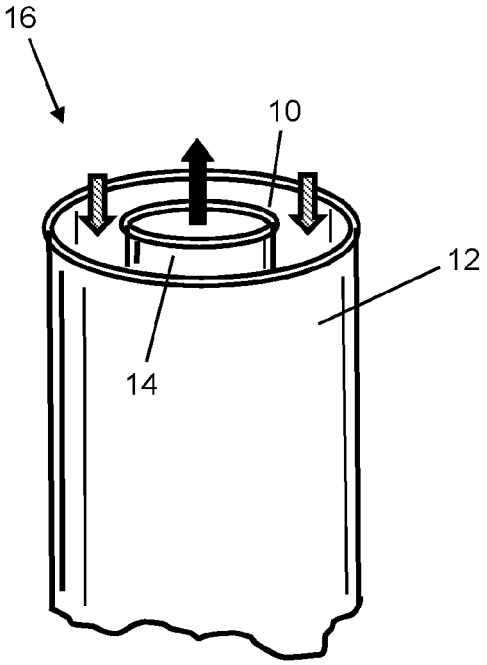
Figure 1 PRIOR ART
FIG. 1 is a schematic perspective view of a prior-art gas light solution, in which lift gas is channelled down an annulus in a pipe-in-pipe riser.
Figure 2:
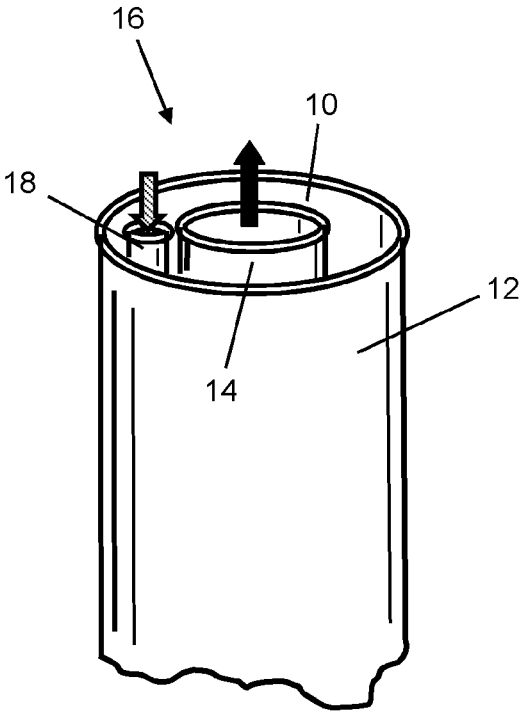
Figure 2 PRIOR ART
FIG. 2 is a schematic perspective view of another prior-art gas lift solution, in which lift gas is piped down a pipe disposed in the annulus of a pipe-in-pipe riser.
Figure 3:
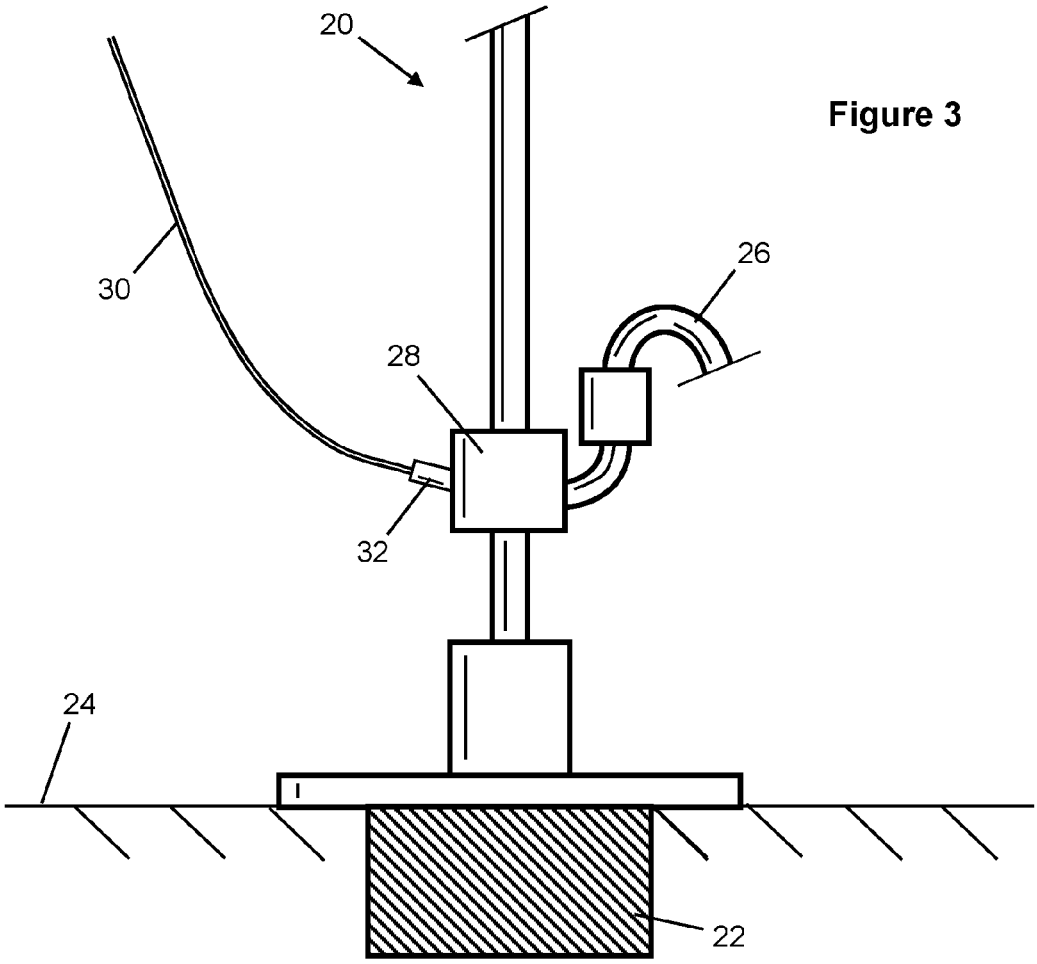
FIG. 3 is a schematic side view of a base portion of a riser tower comprising a gas lift arrangement of the invention.

Referring firstly to FIG. 3 of the drawings, this shows a base portion of a riser tower 20 fitted with a gas lift arrangement in accordance with the invention. Here, conventionally, the riser tower 20 stands up under buoyant tension from a foundation 22 embedded in the seabed 24. A tie-back or spool 26 extending across the seabed 24 from a wellhead (not shown) carries production fluid into the base of the riser tower 20, to flow from there up the riser tower 20 toward the surface.

The spool 26 connects into the riser tower 20 via a connection and injection module 28 shown schematically in FIG. 3. In this instance, a gas lift umbilical 30 also connects into the riser tower 20 via the same connection and injection module 28, at which lift gas pumped from the surface down the gas lift umbilical 30 is injected into the production fluid. The injected lift gas reduces the density of the production fluid to ease its passage up the riser tower 20.

In accordance with the invention, the gas lift umbilical 30 is external to the riser that is embodied here as a riser tower 20. In this example, the gas lift umbilical 30 hangs as a catenary from a surface vessel that pumps the lift gas down the gas lift umbilical 30. The surface vessel that supports the gas lift umbilical 30 is typically an FPSO that also receives production fluid from jumper pipes at the top of the riser tower 20. An FPSO is not shown in FIG. 3 but is shown in FIGS. 6 to 9.

Thus, the gas lift umbilical 30 is supported at an upper end by the surface vessel and at a lower end by the connection and injection module 28. The gas lift umbilical 30 hangs unsupported between its upper and lower ends although some of its weight is supported by its inherent buoyancy in the water. As the upthrust of buoyancy does not exceed its weight, the gas lift umbilical 30 remains negatively buoyant and so adopts a catenary curvature.

Also in accordance with the invention, a downstream section of the gas lift umbilical 30 adjoining the connection and injection module 28 is heated actively by a heating unit 32. This heating allows a check valve between the gas lift umbilical 30 and the production conduit to be eliminated if desired.

Figure 4:
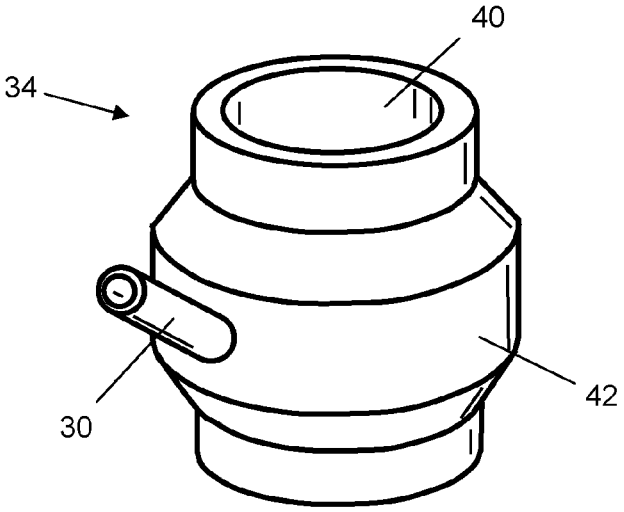
FIG. 4 is a schematic perspective view of a bulkhead insert for use in another gas lift arrangement of the invention.
Figure 5:
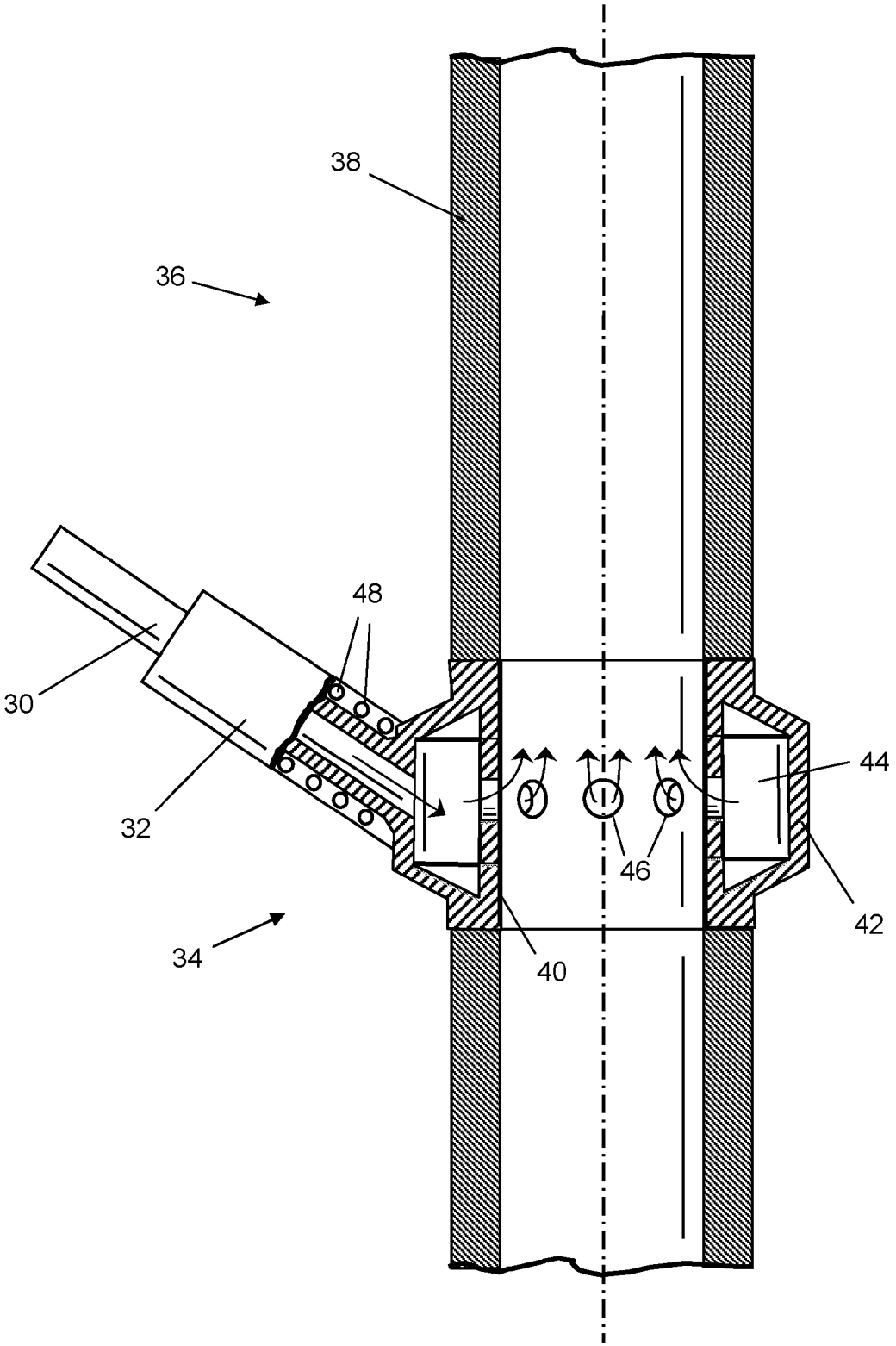
FIG. 5 is a part-sectioned enlarged schematic side view of a riser tower including the bulkhead insert shown in FIG. 4.

A forged bulkhead insert 34 shown in detail in FIGS. 4 and 5 replaces the connection and injection module 28 of FIG. 3. This variant shows the possibility of connecting a gas lift umbilical 30 into a riser tower 36 substantially above the level at which a spool connects into the riser tower 36 to introduce production fluid.

In FIG. 5, the forged bulkhead insert 34 shown in FIG. 4 is welded into an upright production conduit 38 of the riser tower 36. The bulkhead insert 34 comprises a tubular inner wall 40 of similar internal diameter to that of the production conduit 38. The inner wall 40 is surrounded by a radially-enlarged outer wall 42 that is spaced from the inner wall 40 to define an annular chamber 44 between them.

The gas lift umbilical 30 communicates with the chamber 44 of the bulkhead insert 34 to introduce lift gas into the chamber 44. As the arrows in FIG. 5 show, the lift gas is exhausted from the chamber 44 through injection holes 46 spaced circumferentially around the inner wall 40. Once injected radially inwardly through the holes 46 in this manner, the lift gas assists, and is entrained in, a flow of production fluid rising up the production conduit 38.

In a simpler embodiment, the chamber 44 can be omitted by connecting the bore of the umbilical 30 to the bore of the production conduit 38 through a single hole 46.

FIG. 5 also shows, in partial cross-section, a heating unit 32 positioned at the downstream end of the gas lift umbilical 30 adjacent the bulkhead insert 34. The heating unit 32 comprises a series of heating elements 48 such as electrical resistance elements wound around the gas lift umbilical 30. The heating unit 32 may also serve as a connector between the gas lift umbilical 30 and the bulkhead insert 34.

FIGS. 6 to 9 show various riser arrangements that are possible in accordance with the invention. For simplicity, these riser arrangements are shown schematically and are much-shortened in terms of their height above the seabed 24. FIGS. 6 to 8 show riser tower variants whereas FIG. 9 shows a steel catenary riser.

In each of FIGS. 6 to 9, the risers are shown in relation to the seabed 24 and the water surface 50, on which a production facility such as an FPSO 52 floats. The FPSO 52 receives production fluid from the riser and provides lift gas to the riser through a gas lift umbilical 30 that terminates at its downstream end in a heating unit 32. A spool 26 extends across the seabed 24 to convey production fluid into the riser from a wellhead (not shown), to flow up the riser toward the surface 50.

In the riser tower variants of FIGS. 6 to 8, the risers are held upright in tension between a subsea buoy 54 and a foundation 22 embedded in the seabed 24. The buoy 54 is positioned at a depth below the influence of wave action. Catenary jumper pipes 56 extend between the buoy 54 and the FPSO 52 to carry production fluid from the riser to the FPSO 52.

FIG. 6 shows lift gas injection at the base of a riser tower 58 via a connection and injection module 28 like that of FIG. 3. FIG. 6 also shows how the gas lift umbilical 30 hangs freely in the water as a catenary between the FPSO 52 and the connection and injection module 28.

FIG. 7 shows lift gas injection at an elevated mid-water position on a riser tower 60, substantially above the seabed 24. A bulkhead insert 36 like that shown in FIGS. 4 and 5 may be used to inject lift gas at this position, as shown. Again, FIG. 7 shows how the gas lift umbilical 30 hangs freely in the water as a catenary between the FPSO 52 and the bulkhead insert 36.

Like FIG. 6, FIG. 8 shows lift gas injection at the base of a riser tower 62 via a connection and injection module 64. Unlike FIG. 6, the gas lift umbilical 30 of FIG. 8 follows the riser tower 62 in parallel along much of its length, being attached externally to the tower 62 at longitudinally-spaced intervals by tie structures 66. In this instance, only the upstream portion of the gas lift umbilical 30 hangs freely in the water as a catenary, in this case extending between the FPSO 52 and the uppermost tie structure 66.

Finally, FIG. 9 shows the invention in the context of a steel catenary riser 68. The riser 68 hangs as a catenary between the FPSO 52 and a termination module 70 placed on the seabed 24 at an end of the spool 26. The gas lift umbilical 30 hangs freely in the water as a catenary between the FPSO 52 and the termination module 70. The termination module 70 provides for fluid communication between the gas lift umbilical 30 and a production conduit in the riser 68, for injection of lift gas into the production conduit.

Variations are possible within the inventive concept. For example, the embodiment shown in FIG. 7 that employs mid-water gas lift could be adapted to attach the gas lift umbilical to the riser tower with tie structures like those shown in FIG. 8. Similarly, a gas lift umbilical could be attached to the steel catenary riser of FIG. 9 with similar tie structures spaced along some or most of the length of the riser.

More generally, the production riser line can be of various types, for example: a steel catenary riser (SCR), a flexible pipe, a single hybrid riser (SHR), a hybrid riser tower (HRT) or a steel lazy-wave riser (SLWR). Non-electrical power sources such as hot water pipes could be used to heat the gas lift line. The gas lift line can be of various types; any functionally equivalent tubing can replace the gas lift line, for example, an umbilical, a flexible pipe or rigid tubing. Also, a connection and injection module or a bulkhead insert can be of various types; for example, fixed or removable.

The gaseous content of the gas lift line can occasionally be replaced by liquid. For example, during shutdown of the production line, methanol or 'dead oil' may be circulated in a loop from the surface to a lower point inside the umbilical, then back to the surface inside the production line. This flushes the gas lift line and avoids wax, hydrates or asphaltene appearing inside the production line. Also, heating of the umbilical allows better control of cooling-down of the line during shutdown.

A check valve may be provided between the gas lift line and the production conduit, even though the invention allows such a valve to be omitted in preferred embodiments.

The invention claimed is:

1. A subsea riser system with a gas-lift facility, the system comprising:

a production riser comprising at least two riser conduit sections and a bulkhead component inserted in-line in the production riser and joining the two sections of riser conduit together resulting in the flow of a production fluid through the bulkhead component, the bulkhead component comprising at least one lift gas injection port for communicating with the riser conduit sections, the lift gas injection port is in fluid communication with a lift gas inlet;

a heating unit adjacent the lift gas inlet; and a gas lift line external to the production riser and terminating at a downstream end of the gas lift line in the heating unit, arranged to supply lift gas to the lift gas injection port via the lift gas inlet;

the heating unit is external to the production riser, and connects the gas lift line to the lift gas inlet of the bulkhead component to act on the downstream end region of the gas lift line adjacent to the bulkhead component, the heating unit heats the lift gas locally, externally to and adjacent to the production riser prior to injection of lift gas into the production riser.

2. The riser system of claim 1, wherein at least a portion of the gas lift line between the production riser and a lift gas supply hangs as a catenary.

3. The riser system of claim 1, wherein a length of the gas lift line is attached to, and extends along, the production riser.

4. The riser system of claim 1, wherein the bulkhead component also includes an inlet for admitting production fluid into the production riser.

5. The riser system of claim 1 and being without a check valve between the gas injection port and the gas lift line.

6. A method of providing lift gas to a subsea riser system, the method comprising:

conveying lift gas toward a production riser through water, externally of the riser, the riser comprising at least two riser conduit sections and a bulkhead component inserted in-line in the production riser joining two sections of riser conduit together resulting in the flow of a production fluid through the bulkhead component and that further comprises at least one lift gas injection port communicating with the riser conduit sections and a lift gas inlet in fluid communication with the lift gas injection port; and before injecting the lift gas into the production riser, heating the lift gas locally externally to and adjacent to the production riser by a heating unit adjacent the lift gas inlet that connects the lift gas inlet of the bulkhead component to a gas lift line external to the riser.

7. The method of claim 6, comprising conveying the lift gas toward the production riser without introducing external heat to the lift gas, before heating the lift gas locally when adjacent to the production riser.

* * * * *